US005990075A

United States Patent [19]

Terziev

[11] Patent Number: 5,990,075

[45] Date of Patent: Nov. 23, 1999

[54] METHOD OF REMOVING GREASE AND OIL FROM DRY CLOTHING USING POWDER CONTAINING CLAY AND TALC

[76] Inventor: Nicola Terziev, 5100 N. Ocean Blvd., #1407, Fort Lauderdale, Fla. 33308

[21] Appl. No.: 09/027,913

[22] Filed: Feb. 23, 1998

[51] Int. Cl.[6] ..... C11D 7/02

[52] U.S. Cl. ..... 510/507; 510/285; 510/445; 510/446; 510/511; 510/516

[58] Field of Search ..... 510/285, 445, 510/446, 507, 511, 516

[56] References Cited

U.S. PATENT DOCUMENTS

| | | | |
|---|---|---|---|
| 4,076,633 | 2/1978 | Edwards et al. | 510/516 |
| 4,178,254 | 12/1979 | Leikhim et al. | 510/516 |
| 4,493,781 | 1/1985 | Chapman et al. | 510/278 |

*Primary Examiner*—Yogendra Gupta
*Assistant Examiner*—Gregory R. Delcotto

[57] ABSTRACT

A powdered cleaning product designed to extract oil and grease from fabric. It consists of the dry mixture of powdered montmorillonite clay and powdered talc, which are combined in a specific ratio. The mixture absorbs oil and grease from garments without leaving any rim around the spot or otherwise damaging the fabric.

1 Claim, No Drawings

METHOD OF REMOVING GREASE AND OIL FROM DRY CLOTHING USING POWDER CONTAINING CLAY AND TALC

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention is designed for easy dry cleaning of greasy spots which appear on clothes after meals, cooking, etc.

The following problem exists at the present. After meals people often get greasy spots on their garments. These stubborn oily stains cannot be easily removed either by conventional laundry or dry cleaning. Frequently such stains are still visible on the fabric even after professional dry cleaning, which is costly and time-consuming. Some oily stains can cause a permanent damage to clothes after it has been washed once.

Presently existing products on the market for spot removal are liquid-based. When applied on the spot, they leave a rim around the spot, causing permanent damage to the garment.

BRIEF SUMMARY OF THE INVENTION

This invention is designed to extract grease from spots which appear on clothes after meals or after handling oil products. When used properly, the product absorbs oils from dry fabrics, leaving them clean and rim-free.

The product is a combination of two components: powdered white montmorillonite clay and powdered talc. Both minerals belong to a phyllosilicate group and have high absorbing properties, which makes them ideally suited for the purpose of oil extraction.

Montmorillonite [$Al_4(Si_4O_{10})_{2x}nH_2O$, hydrated aluminum silicate] is an abundant clay formed by weathering in many warm climates. It is also the main clay product of the weathering of volcanic ash. It has the structure and cation composition that gives it the ability to absorb large quantities of liquid, which spreads the layers apart and makes them easily cleavable. Montmorillonite has the highest absorption ability of all clays.

Talc [$Mg_3(Si_2O_5)_2(OH)_2$, hydrous magnesium silicate] is an alteration product of magnesium silicates in ultramafic rocks, common in regionally metamorphosed rocks (schists). It is also formed by metasomatism in impure dolomitic marbles. It has a layered structure, in which the layers are electrically neutral. The attractive forces between them are consequently feeble, and the mineral cleaves readily.

Experiments indicate that the above minerals give the best performance when mixed in a ratio of 2 parts talc to 1 part clay.

The invention has several advantages:

It is extremely effective in removing grease spots from any fabric.

It is non-toxic, contains no environmental pollutants or hazardous materials.

It is easy and safe for use at home.

It will save time and money to the consumer.

DETAILED DESCRIPTION OF THE INVENTION

Oil is a non-polar substance. Like dissolves like in chemistry; therefore, oil cannot be dissolved with a polar substance such as water. Even addition of soap to water frequently gives poor results when used to remove an oil stain. Additionally, not all fabrics can be washed in water.

An alternative method has been designed to overcome this problem. Since oil can be extracted from fabric, a mixture of the two non-polar substances acts as a absorbent. The mixture is dry, making it safe to use even on fabrics that cannot undergo a conventional laundry. The mixture consists of a powdered white montmorillonite clay and powdered talc mixed in a 1:2 ratio, which has been experimentally established. Experiments showed that neither of the minerals gave a 100% satisfactory results when used alone. Clay was best in absorption of lighter oils, while talc showed better results in absorption of heavier oils. Thus absorption properties of one mineral were complemented by the addition of another, and together they were capable of absorbing a wider variety of oils and grease. Following is the explanation of the absorption properties of both minerals.

CLAY: The major structure of colloidal clay particles is that of layers of plates or flakes. The individual size and shape of the laminations is largely determined by the developmental conditions and the type of mineral concerned. This plate-like structure and finely divided state gives clays a very large specific surface area; for example, the external surface area of 1 g colloidal clay is approximately 1000 times that of 1 g coarse sand. This large surface area is of a great importance for the absorption properties of clays.

All clay minerals have the basic structures of sheet silicates; sheets of silica tetrahedra alternate with sheets of alumina octahedra. Clay minerals are grouped into two categories depending on the layer structure. Group 1 minerals (kaolinite) are built from three sheets—one hexagonal and two complete sheets. Group 2 minerals (micaceous clays, vermicules and montmorillonites) have symmetrical structures of two complete sheets sandwiched between hexagonal sheets. Group 1 minerals have a rigid overall lattice structure held together by weak hydroxyl bonds, which prevents water and cations from entering between the structural units. This, coupled with a small negative charge, is one of the reasons for the low absorption capacity of kaolinite, which is makes it useful for manufacturing of pottery and ceramics, but less valuable as an absorbent.

Group 2 minerals have crystal units that are held one to another by electrostatic interactions between surface negative charges in the outer sheets of one unit and the positive charges in sheets of other crystal units. In micaceous clays and vermicule clays the force of attraction between crystal units can be strong, which adversely affects their absorption properties. In montmorillonite $Al_4(Si_4O_{10})_{2x}nH_2O$, there are no hydroxyl bonds available on the outside of the layers. The absence of hydroxyl bonding between the oxygen anions in adjacent units means that the units can be easily separated, making it easy for the mineral structure to expand, allowing water, cations or oil to move between the crystal units. Thus, the area exposed for cation exchange is greatly increased, making montmorillonite a good absorbent of water and oil. Montmorillonite has about 10 to 15 times the cation absorption capacity of kaolinite. For example, 1 kg of montmorillonite can accommodate 2.5 liters of water and still not be liquid in comparison with 1 kg of kaoilinite, which turns into liquid after the addition of only 1.4 liters of water.

TALC: Talc [$Mg_3(Si_2O_5)_2(OH)_2$] belongs to a class of phyllosilicates with layer structures which contain sheets of six-membered rings of tetrahedra in which the tetrahedra all point the same way. The dimensions of the $SiO_4$ tetrahedra are such that the O—O spacing between oxygen at the peaks of the tetrahedra is very nearly the same as the O—O spacing between adjacent oxygen on a $MgO_6$ octahedron. In talc the layer of $MgO_6$ octahedra is sandwiched between two sheets of $SiO_4$ tetrahedra in six-membered rings. Silicon-oxygen sheets are formed by sharing of oxygen atoms between double chains. These ionic bonds are weaker than the silicon bonds between the sheets, and sandwich layers are essentially uncharged and are held together only by Van der Waals forces. This explains why talc is an extremely soft and smooth mineral which cleaves easily into thin layers. This property along with low moisture content gives talc its ability to absorb oil and grease. Talc's structure provides its chemical inertness, which is also important, because it will help to avoid discoloration when the product is applied on fabrics.

What I claim as my invention is:

1. A method of removing grease and oil from soiled, dry, clothing wherein said method consists essentially of applying a cleaner, in powder form, consisting of a mixture of montmorillonite clay and talc wherein said clay and talc are mixed in a 1:2 ratio, to the dry clothing.

* * * * *